US006416455B1

(12) United States Patent
Aizawa et al.

(10) Patent No.: US 6,416,455 B1
(45) **Date of Patent: *Jul. 9, 2002**

(54) ROTOR FOR CENTRIFUGE HAVING A SPECIMEN HOLDER THAT ACCOMODATES AN INCREASED NUMBER OF SPECIMENS

(75) Inventors: Masaharu Aizawa; Jun Sato; Yoshitaka Niinai, all of Hitachinaka (JP)

(73) Assignee: Hirachi Koki Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/553,955

(22) Filed: Apr. 21, 2000

(30) Foreign Application Priority Data

Apr. 23, 1999 (JP) ..... 11-116334
Feb. 25, 2000 (JP) ..... 2000-049961

(51) Int. Cl.[7] ..... B04B 5/02
(52) U.S. Cl. ..... 494/16
(58) Field of Search ..... 494/16, 20, 21, 494/31, 33, 85; 422/72

(56) References Cited

U.S. PATENT DOCUMENTS 4,295,601 A * 10/1981 Cowell
4,341,342 A * 7/1982 Hara
4,375,272 A * 3/1983 Sutton, III ..... 494/16
4,941,867 A * 7/1990 Tominaga ..... 494/20
5,480,484 A * 1/1996 Kelley et al. ..... 422/72
5,545,118 A * 8/1996 Romanauskas ..... 494/16
6,190,300 B1 * 2/2001 Demsia et al.

* cited by examiner

*Primary Examiner*—Charles E. Cooley
(74) *Attorney, Agent, or Firm*—McDermott, Will & Emery

(57) ABSTRACT

A rotor for centrifugal separation of liquid specimens introduced on a microplates or a collective unit of microtubes in form of microplates (box type specimen holder) under centrifugal acceleration. Within the rotor, specimen receptacle are placed in radial direction with respect to the axis of rotation, the box type specimen holder is placed in each of the specimen receptacles, and there is provided a member for preventing the box type specimen holder from falling down, or a pad is arranged between the box type specimen holder and inner wall in parallel to the axis of rotation, and centrifugal force to be applied on the box type specimen holder is received by the pad, which is designed in such shape as to approximately follow the shape of the outer wall, and centrifugal separation can be performed with the specimen receptacle inserted from above.

14 Claims, 6 Drawing Sheets

ROTOR FOR CENTRIFUGE HAVING A SPECIMEN HOLDER THAT ACCOMODATES AN INCREASED NUMBER OF SPECIMENS

BACKGROUND OF THE INVENTION

1. Field of the Invention

The present invention relates to a rotor for centrifuge used in the field of medicine, pharmaceutical science, genetic engineering, etc., and in particular, to a rotor for centrifugal separation of microplates or a collective unit of microtubes in form of microplates.

2. Description of the Related Art

A conventional type rotor for microplate is described, for example, in Japanese Utility Model Publication 57-934 or Japanese Patent Application 7-316545. A perspective view of the rotor is shown in FIG. 11. In FIG. 11, the rotor comprises a rotor body 21, a bucket 23, and an adapter 25. When it is rotated via a driving shaft of a centrifuge, the bucket 23 is swung, and centrifugal acceleration is applied on a liquid specimen in a microplate, which is supported on the bucket 23 by the adapter 25. The rotor with such arrangement having maximum rotational speed of 2,000 to 6,000 rpm and maximum centrifugal acceleration of 600 to 5,000×g (gravitational acceleration) is commercially available.

One of the applications, to which the present invention is intended, is the improvement of efficiency in the research activities of DNA and RNA in the field of genetic engineering. In DNA sequencing process in this field, centrifugal separation of DNA as specimen is one of the most important processes. In particular, in the method to collect DNA precipitated by ethanol precipitation processing, which is performed by adding adequate quantity of ethanol to a solution containing DNA, a microtube (test tube) made of plastics of about 0.2 to 2 ml in volume has been used in the past. An angle rotor or a swing rotor compatible with the microtube has been used, and centrifugal separation has been performed at 12,000 rpm (about 10,000×g) for about 10 minutes. Or, the rotor for microplates as described above has been used for centrifugal separation at 6,000 rpm (about 5,000×g) for about 30 minutes. In these operations, each of the microtubes must be handled one by one, and this means that very complicated procedure is required. Also, in the former case, because of the limitation of the system for centrifugal separation, processing in one operation has been limited to 48 microtubes at the most. In the latter case, the number of the specimens to be processed is high, but centrifugal acceleration is low, and this means that the separation time as long as 30 minutes is required.

Various types of experiments are now being performed in the field such as examination on human health, research activities of DNA, RNA, etc. or histological culture using the centrifuge. In this respect, there are strong demands on the improvement of efficiency in the process of centrifugal separation, which must be performed in the courses of the examinations, tests, and experiments. The efficiency in the centrifugal separation process can be improved by increasing centrifugal acceleration to be applied on the specimens by increasing the rotational speed and by increasing the number of the samples to be processed at one time.

In some of the conventional type swing rotor for microplates, efficiency can be improved by the use of the microplates, which make it possible to process 96 specimens per one microplate at one time. However, when it is tried to improve the efficiency of centrifugal separation process by increasing the rotational speed, problems of strength arises due to the structure of the rotor, and the rotational speed (centrifugal acceleration) cannot be increased. also, because of the structural feature of the swing rotor, it must have large diameter to improve the efficiency. This causes the problem such as increased windage loss during rotation at high speed. Thus, it is not possible to attain the purpose because the rotational speed and the centrifugal acceleration cannot be increased.

SUMMARY OF THE INVENTION

It is an object of the present invention to make it possible to use microplates or a collective unit of microtubes in form of microplates currently in use (hereinafter referred as "microplate") under high centrifugal acceleration, to improve efficiency of centrifugal separation process by accommodating more specimens and to reduce the manufacturing cost of the rotor.

The above object can be accomplished by a rotor for centrifuge to apply centrifugal force on a specimen by holding and rotating a box type specimen holder, such as a microplate, with a plurality of recesses for accommodating the specimens, said rotor for centrifuge comprises an outer wall with inner side thereof in parallel to a rotation shaft, and specimen receptacles each extended in direction of the rotation shaft along said outer wall, whereby each of said specimen receptacles is placed in radial direction with respect to the rotation shaft, said box type specimen holder is arranged in each of said specimen receptacles, and there is provided means for preventing said box type specimen holder from toppling or falling down. Also, the present invention provides a rotor for centrifuge to apply centrifugal force on a specimen by holding and rotating a box type specimen holder with a plurality of recesses for accommodating the specimens, said rotor for centrifuge comprises an outer wall with inner side thereof in parallel to a rotation shaft, and specimen receptacles each extended in direction of the rotation shaft along said outer wall, whereby a pad receiving centrifugal force to be applied on said box type specimen holder and having such shape as to engage with the shape of said outer wall is arranged between said box type specimen holder and said inner wall in parallel to said rotation shaft.

BRIEF DESCRIPTION OF THE DRAWINGS

The objects and features of the present invention will become more readily apparent from the following detailed description taken in conjunction with the accompanying drawings in which.

DESCRIPTION OF THE PREFERRED EMBODIMENTS

Figure 9:
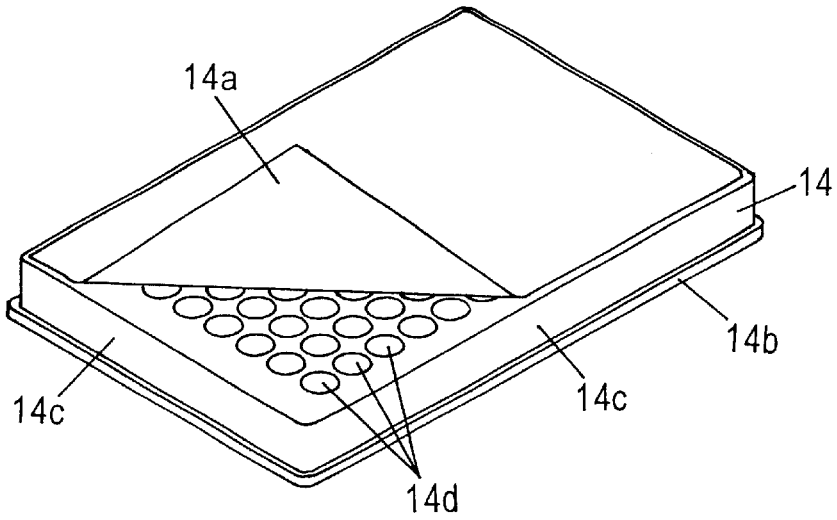
FIG. 9 is a perspective view showing the form of a microplate to be used in the rotor of the present invention.
Figure 10:
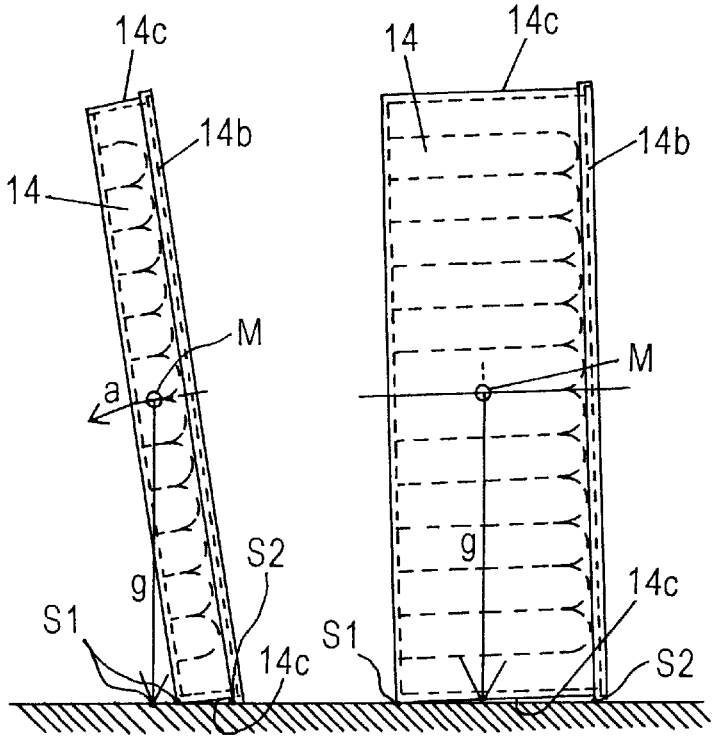
FIG. 10 is a side view when the lateral side of the microplate to be used in the rotor of the present invention is erected vertically on a flat surface.
Figure 11:
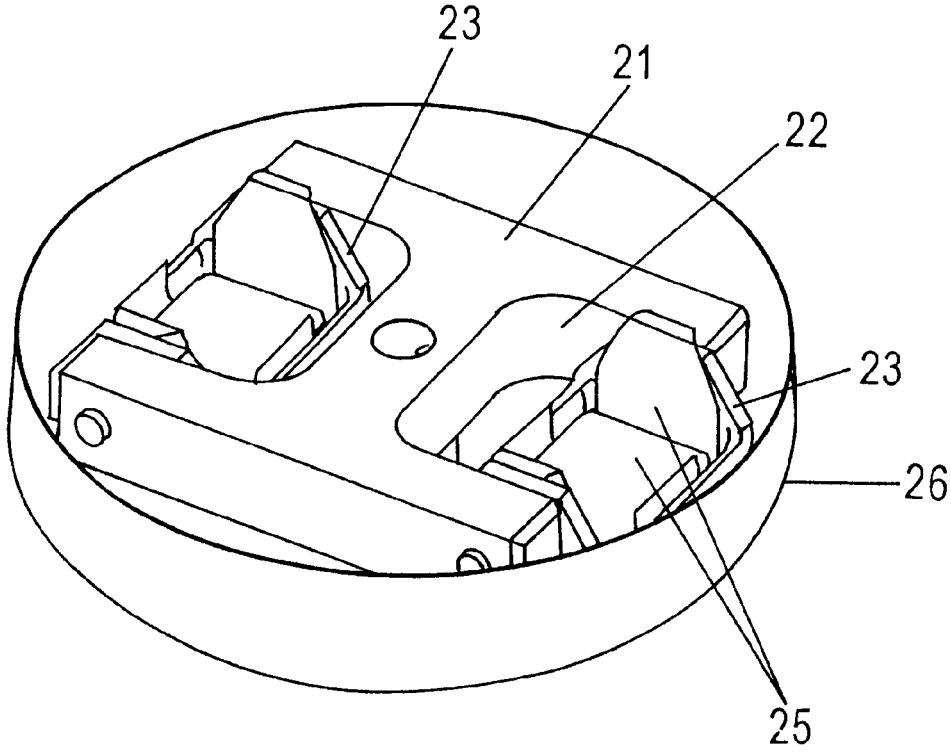
FIG. 11 is a perspective view of a conventional type rotor.

First, description will be given on structure of a microplate used in a rotor of the present invention referring to FIG. 9 and FIG. 10. As shown in FIG. 9, a microplate 14 is a box type container with dimensions of about 130 mm×90 mm×10 to 50 mm (length×width×height). On its upper surface, a number of small recesses 14*d* for accommodating specimens are arranged orderly in longitudinal and lateral directions. Specimens such as blood components or culture solution are placed into the recesses 14*d* and are centrifuged. On the microplate 14, a seal 14*a* is attached for preventing leakage of the specimens placed in the recesses 14*d*. A collective unit comprising a number of microtubes made of plastics inside having approximately the same outline and dimensions as the microplate 14 used for the same field of application is also known. In general, the microplate 14 is produced by molding of plastic materials such as polystyrene, polypropylene, etc., and it is used as disposable type.

The microplate 14 as described above is attached on a rotor with the lateral side 14*c* of the microplate 14 facing downward, and if this is used for centrifugal separation, the problems of strength related to the swing rotor as described above does not occur. Also, no problem occurs in the increase of windage loss due to large diameter caused from structural feature of the s wing rotor. Thus, it can be rotated at high speed, and the above object can be accomplished. However, if t he microplate is attached on the rotor simply by erecting it on a flat surface with the lateral side 14*c* facing downward, the problem arises due to the structure of the microplate 14.

Description will be given now on a case where the microplate 14 is erected on a flat surface with the lateral side 14*c* facing downward referring to FIG. 10. Normally, a collar 14*b* is arranged on lower periphery of the microplate 14, and it is extended more in outward direction than the lateral side 14*c* of the microplate 14. The lateral side 14*c* of the microplate 14 is generally provided with a certain inclination compared with the lateral side 14*c* of the microplate 14 so that it can be easily withdrawn from the mold at the time of manufacture. In this respect, when the lateral side 14*c* of the microplate 14 is placed on a flat surface, the microplate 14 itself is tilted in lateral direction (leftward in FIG. 10), i.e. in a direction of the recesses 14*d*, due to the inclination of the collar 14*b* and/or the lateral side 14*c*.

Thickness of the microplate 14 varies from thin to thick. As shown on the left part of FIG. 10, when thickness of the microplate 14 is thin and position of gravitational force g directed downward from the center of gravity of the microplate 14 is deviated from the points S1 and S2, i.e. the points serving as points of support where the microplate 14 comes into contact with the flat surface when it is erected vertically, the microplate 14 cannot be erected vertically with its lateral side 14*c* facing downward, and the microplate topples down. If the microplate 14 topples down, problem is not simply the difficulty to attach it to the rotor. When the microplate 14 is attached on the rotor vertically and the rotor is rotated at high speed, centrifugal force is applied on the microplate 14, and the microplate 14 does not fall down. However, when rotation of the rotor is stopped after centrifugal separation, the microplate 14 topples down, and the separated specimens are intermingled with each other.

To solve the above problem, it is necessary to provide means for preventing the microplate 14 from toppling down when it is attached to the rotor.

Figure 1:
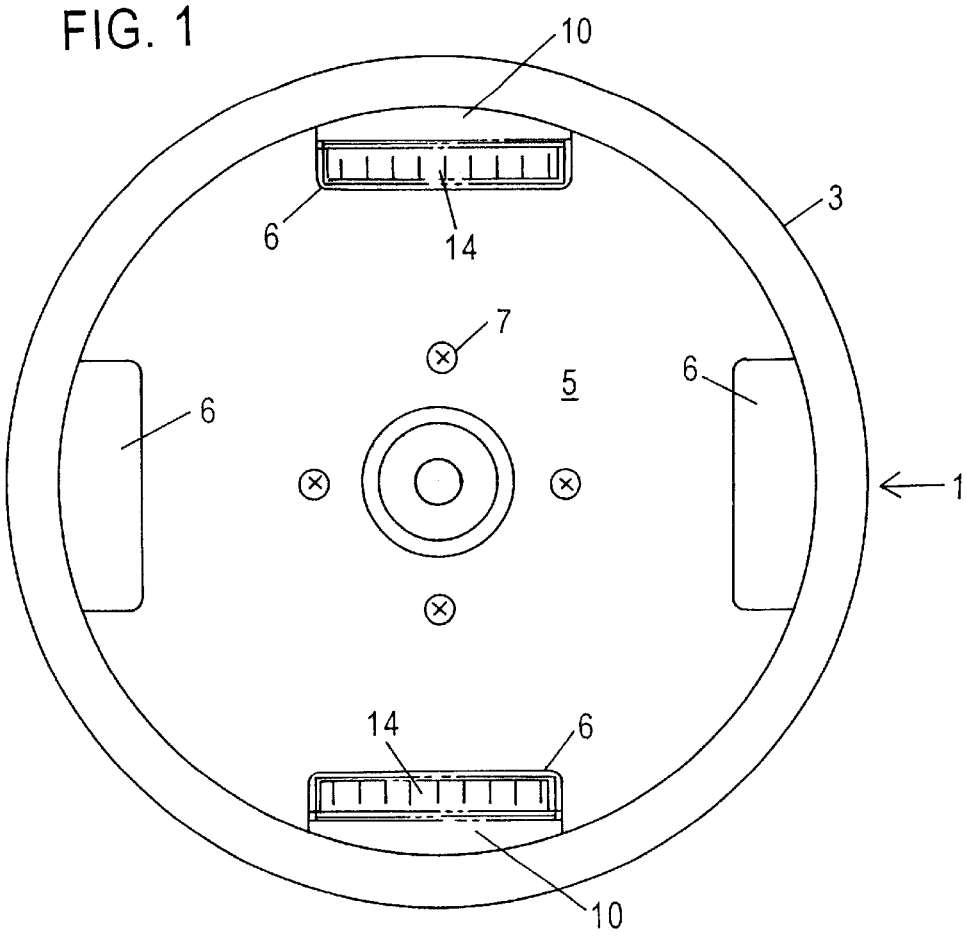
FIG. 1 is a top view of a rotor of a first embodiment of the present invention.
Figure 2:
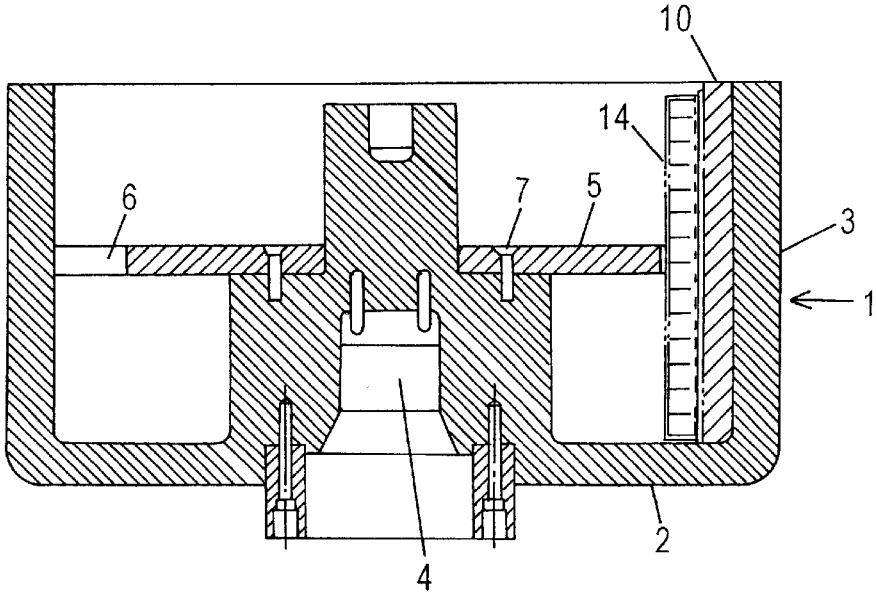
FIG. 2 is a longitudinal sectional view of the rotor of FIG. 1.

FIG. 1 is a top view of a rotor 1 of a first embodiment of the present invention. In FIG. 1, the rotor 1 has a specimen receptacle 6 on each of four sides. In the figure, two receptacles at left and right are empty, i.e. there is no box type specimen holder 14 such as microplate in each of the receptacles. In two receptacles at upper and lower portions, box type specimen holders, i.e. microplates 14, are present. FIG. 1 is a longitudinal sectional view of the rotor of FIG. 1. The left half of the figure shows a sectional view in left-to-right direction, and the right half of the figure shows a sectional view in up-to-bottom direction, i.e. a condition where the microplate 14 is placed in it.

In these figures, a rotor body 1 has a driving shaft connecting unit 4, and an outer wall 3 in cylindrical shape is extending upward from a bottom plate 2. A guide plate 5, serving as means for preventing the microplate 14 from toppling down, is mounted nearly at the central position in the rotor 1, and it is fixed on the rotor body 1 by fixing screws 7. At four points on outer periphery of the guide plate 5, there are provided specimen receptacles 6 for receiving the microplates 14 in such manner that the microplates can be removably arranged with adequate spacing between them. The guide plate 5 also plays a role to prevent the microplates 14 and pads 10 from toppling down. Each of the pads 10 serves as a seat for the microplate 14 and also transmits centrifugal force applied on the microplates 14 as the pads come into contact with inner periphery of the outer wall 3.

When the microplates 14 are used in this rotor, the microplates 14 are inserted into the rotor by tilting at an angle of 90 degrees from the condition where the specimens are introduced. In order that the liquid does not spill out, it is necessary to attach a sealing member 14*a* on upper surface of each microplate 14. During centrifugal separation, the liquid surface is erected in vertical direction due to centrifugal force, and particles in the liquid are deposited at the bottom of specimen accommodating recess as precipitates and these particles cannot be easily removed or peeled off. As a result, when the liquid is restored to the original position after centrifugal separation, it is possible to collect the precipitates or the liquid without any problem.

Figure 3:
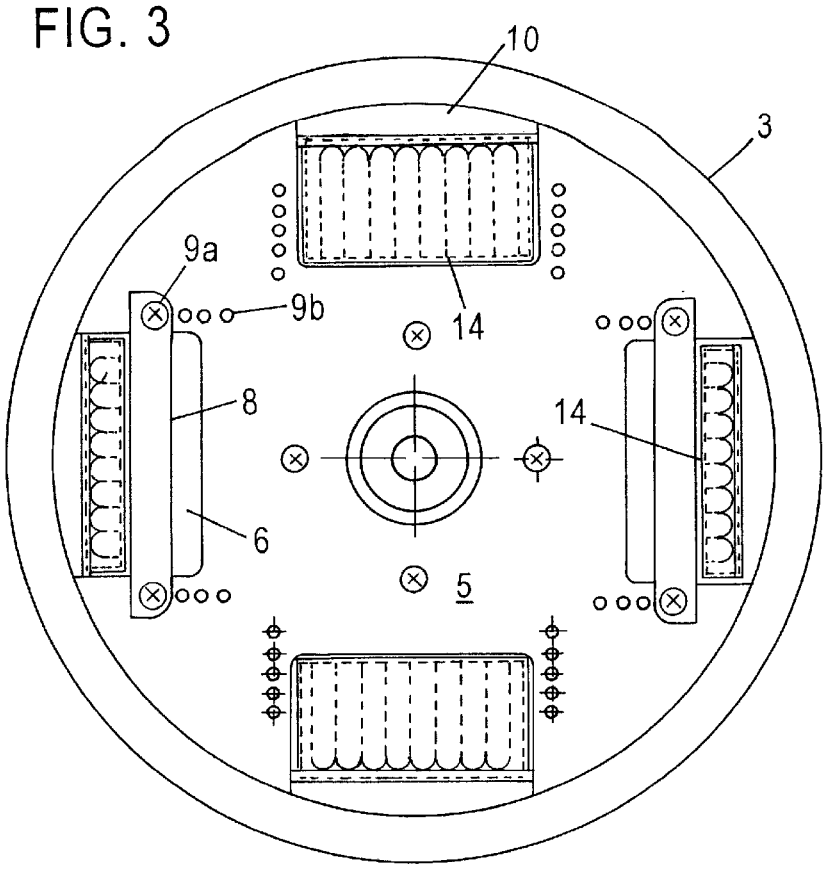
FIG. 3 is a top view of a rotor of a second embodiment of the present invention.
Figure 4:
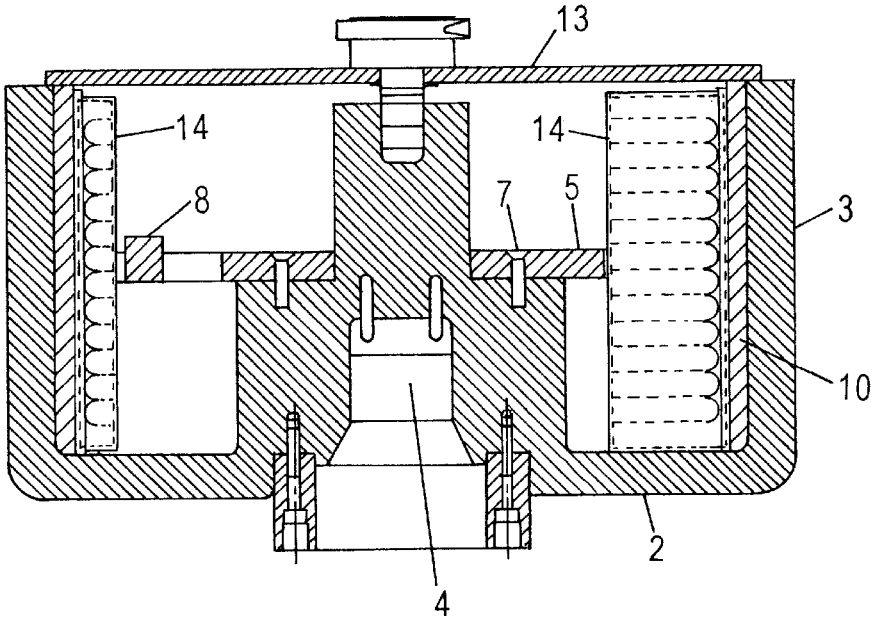
FIG. 4 is a longitudinal sectional view of the rotor of FIG. 3.

FIG. 3 is a top view of a rotor of a second embodiment of the present invention, and FIG. 4 is a longitudinal sectional view of the rotor shown in FIG. 3. In FIG. 4, the left half of the figure shows the condition where a thin microplate 14 is inserted, and the right half of the figure shows the condition where a thick microplate 14 is inserted. The upper portion of the figure represents the condition where a cover unit 13 to cover upper opening of the rotor body 1 is mounted. The cover unit 13 exerts action in a direction to reduce resistance (windage loss) associated with the rotation of the rotor, and this makes it possible to rotate the rotor at high speed. In the arrangement shown in FIG. 3 and FIG. 4, in order that the operation can be performed even when thickness of the microplate 14 is changed, it is designed in such manner that the specimen receptacle 6 mounted on the guide plate 5 is deeper in radial direction, and there is provided the means for preventing the microplate from toppling down (fixed plate 8), which can be changed depending on the thickness of the microplate 14. On the fixed plate 8, adjustment fixing screws 9*a* are provided so that position of the fixed plate 8 can be adjusted. Further, on the guide plate 5, a plurality of threaded holes 9*b* are arranged so that the adjustment fixing screws 9*a* can be inserted. As it is evident from the conditions of the specimen receptacles 6 on the upper and the lower portions of FIG. 3 and from the right half of FIG. 4, when the thick microplate 14 is used, the fixed plate 8 may be removed, and the toppling of the specimen receptacles may be prevented directly by the guide plate 5.

Figure 5:
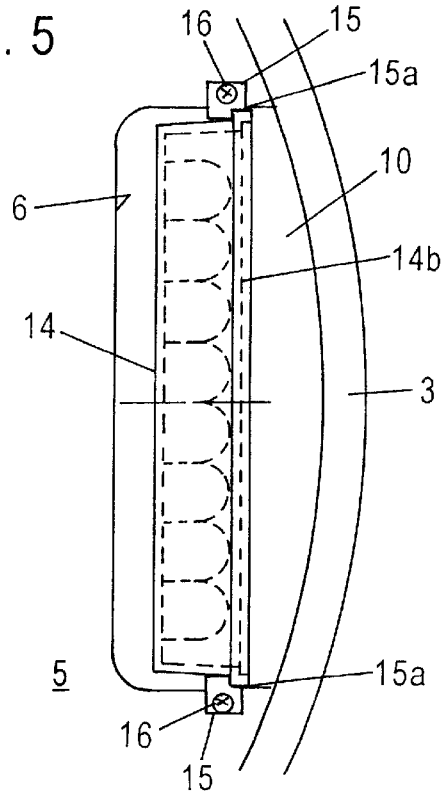
FIG. 5 is a partial top view of a rotor of a third embodiment of the present invention.

FIG. 5 is a partial top view of a rotor of a third embodiment of the present invention. The portions not shown in FIG. 5 are the same as those of the above embodiment, and these portions are not described here. In the embodiment shown in FIG. 5, the specimen receptacles 6 are provided on the guide plate 5, and the toppling of the microplate 14 is prevented by supporting a collar 14*b* on the lateral portion of the microplate 14. More concretely, a stopper 15 having a notch 15*a* to be engaged with the collar 14*b* of the microplate 14 in radial direction is arranged on the guide plate 15 using a screw 16 in order to prevent the microplate 14 from toppling down. It is desirable that the position of the stopper 15 can be adjusted depending on the thickness of the collar 14*b* of the microplate 14. In this embodiment again, a pad 10 is disposed between the microplate 14 and the outer wall 3 of the rotor. Detailed description of the pad 10 will be described below, and this pad is provided with the purpose of preventing damage of the microplate 14 by centrifugal force.

Figure 6:
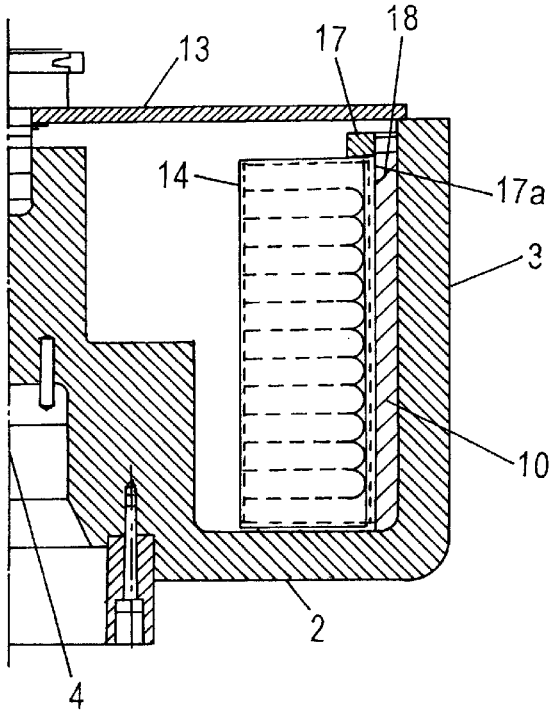
FIG. 6 is a partial longitudinal sectional view of a rotor of a fourth embodiment of the present invention.

FIG. 6 is a partial longitudinal sectional view of a rotor of a fourth embodiment of the present invention. In the embodiment shown in FIG. 6, the toppling of the microplate 14 is prevented by supporting the collar 14*b* above the microplate 14. More concretely, a stopper 17 having a notch 17*a* to be engaged with the collar 14*b* above the microplate 14 in radial direction of the rotor is fixed on the pad 10 using a screw (or pin) 18 to attain the purpose. Although the stopper 17 shown in FIG. 6 is fixed on the pad 10, this may be fixed on the outer wall 3, for example. Further, the stopper 17 may be arranged to match each microplate 14, or the stopper 17 may be designed in doughnut-like shape so that each of the microplates 14 can be held by a single stopper 17.

Figure 7:
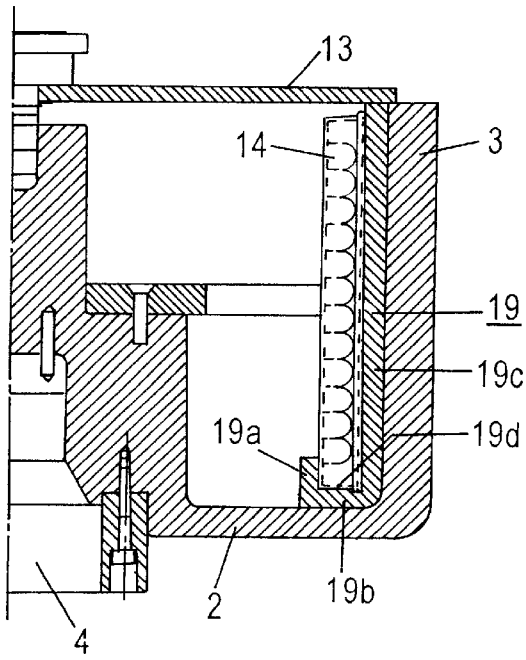
FIG. 7 is a partial longitudinal sectional view of a rotor of a fifth embodiment of the present invention.

FIG. 7 is a partial longitudinal sectional view of a rotor of a fifth embodiment of the present invention. In the embodiment shown in FIG. 7, there is provided a support member 19 for supporting the microplate 14, and this support member 19 serves as the means for preventing the microplate 14 from toppling down. The support member 19 comprises an inner side supporting segment 19*a* for supporting lateral side of the rotation shaft of the microplate 14, a bottom supporting segment 19*b* for supporting the lower portion of the microplate 14, and a backside supporting segment 19*c* for supporting the entire backside of the microplate 14. A surface 19*d* of the bottom supporting segment 19*b* in contact with the microplate 14 consists of a portion to receive the collar 14*b* of the microplate 14 and a portion with inclination to follow the shape of the lateral surface 14*c*. In the embodiment shown in FIG. 7, the toppling of the microplate 14 is prevented by the action of the inner side supporting segment 19*a* and the bottom supporting segment 19*b* of the support member 19. This may be accomplished by the action of either one of the inner side supporting segment 19*a* or the bottom supporting segment 19*b*. In case the toppling of the microplate 14 is prevented only by the action of the inner side supporting segment 19*a*, the bottom supporting segment 19*b* may not necessarily follow the form of the microplate 14. In case the toppling is prevented only by the action of the bottom supporting segment 19*b*, the inner side supporting segment 19*a* may not be provided. The backside supporting segment 19*c* for supporting almost the entire backside of the microplate 14 serves as a seat of the microplate 14 in the same manner as the pad 10 in the above embodiment. It also comes into contact with inner periphery of the outer wall 3 and serves to transmit centrifugal force to the microplate 14.

Figure 8:
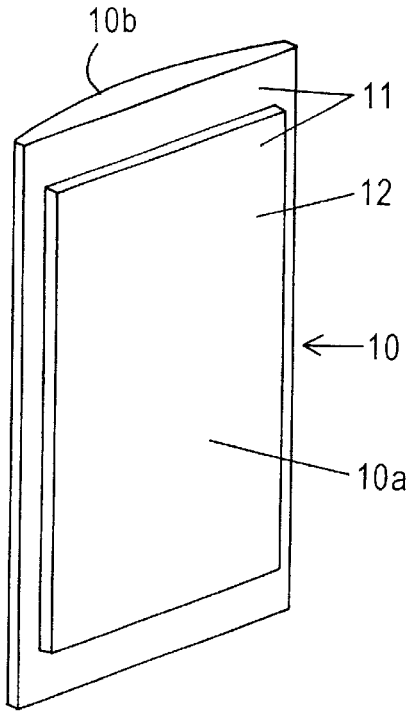
FIG. 8 is a longitudinal sectional view of an embodiment of a pad to be used in the rotor of the present invention.

Next, description will be given on the pad 10 used in the above embodiment referring to FIG. 8. FIG. 8 is a perspective view of the pad 10. On a seat surface 11 of the microplate 14, there is provided a projected segment 15 on the central portion, and the projected segment 12 receives rear bottom surface of the specimen accommodating recess of the microplate 14 and supports centrifugal load to be applied on the microplate 14. This makes it possible to support the microplate 14 under high centrifugal acceleration without damaging it. In the embodiment shown in FIG. 8, the projected segment 12 is provided. This is because it is necessary to cope with different types of microplates 14, in which rear surface height of the specimen accommodating recess 14*d* of the microplate 14 is different from rear surface height of the collar 14*b*. In case a microplate is used, which has the rear surface height of the specimen accommodating recess 14*d* equal to the rear surface height of the collar 14*b*, the seat surface 11 may be designed with the entire flat surface without the projected segment 12. Rear surface 10*b* to match the seat surface 11 of the pad 10 is designed in arcuate surface along inner side of the cylindrical outer wall 3 of the rotor 1. When the seat surface 11 is arranged on inner side of the outer wall 3 of the rotor 1, it is possible to dispose the microplate 14 under high centrifugal force. However, cutting and machining of the rotor body 1 cannot be performed easily, and the manufacturing cost may be increased. In the present invention, the inner side of the cylindrical outer wall 3 of the rotor 1 is designed in circular shape to facilitate machining, and the curvature of the circular portion is approximately equal to the curvature of the rear surface 10*b*. This pad 10 may be applied not only on a type of microplate 14, which topples down when it is placed on a flat surface (i.e. a thin microplate as shown on the left half in FIG. 10), but also on a microplate 14, which does not fall down when it is placed on a flat surface (i.e. a thick microplate as shown on the right half of FIG. 10).

In FIG. 8, the surface of the projected segment 12 is designed as flat, while may not be necessarily designed as flat when receiving the rear surface of the specimen accommodating recess 14*d* of the microplate 14. For example, the rear surface of the specimen accommodating recess 14*d* may be designed in convex shape, and a recess to receive such convex portion may be provided on the projected segment 12. If it is designed in such manner that the recess on the projected segment 12 is formed a little smaller than the size of the convex portion and it is made of an elastic material so that a certain force (i.e. a force able to prevent the toppling of the microplate) or higher force is applied on the rear surface of each specimen accommodating recess 14*d*. Then, the recess provided on the projected segment 12 serves as the means for preventing the microplate 14 from toppling down.

In the embodiments described above, the rotor body 1, the guide plate 5 and the fixed plate 8 can be manufactured using aluminum alloy or titanium alloy. It is naturally possible to use plastics or a composite material if these have sufficient strength. As fixing screws, metal is preferably used because of the strength. The pad is used to simply support the centrifugal load applied on the microplate, and plastics may be used, which can endure such pressure. In the rotor with the arrangement shown in FIG. 1, using the rotor body and the guide plates made of aluminum alloy, a rotor with maximum diameter of 288 mm was manufactured. As a result, a rotor to be operated at 10,000 rpm with 13,000×g could be designed. If aluminum or titanium alloy having higher strength is used, it would be possible to have a rotor which can be operated at high speed. The number of the specimen receptacles can be increased to 4 to 6, and working efficiency can be increased by the operation at higher speed and by processing more quantity of specimens.

The manufacturing cost of the rotor of the present invention can be divided to material cost and processing or machining cost. The material cost is fixed in the amount because a rotor must have such size as to match the dimensions of the microplate, and this depends upon the amount of processing or machining cost. For example, in the rotor of the embodiment shown in FIG. 1, the rotor body 1 is manufactured by simple lathe turning. The guide plate 5 can be manufactured by lathe turning and milling machining, and the pad 10 can be manufactured by molding of plastics. As a result, processing or machining cost can be comparatively lower, and it can be manufactured at lower cost compared with the conventional type swing rotor.

In the effects of actual centrifugal separation, it is estimated that ethanol precipitation processing of DNA can be accomplished in about 10 minutes because it is possible to attain centrifugal acceleration of 10,000×g or more.

According to the present invention, it is possible to rotate microplates or a collective unit of microtubes in shape of microplates under high centrifugal acceleration. Because the specimens 2–3 times as many as the specimens in conventional system can be accommodated, more liquid specimens introduced into microplater can be quickly processed by centrifugal separation.

While the present invention has been described with reference to embodiments thereof, various modifications and variations may be made without departing from the sprit of the present invention which is defined by the claims.

What is claimed is:

1. A rotor with a box type specimen holder for centrifuge to apply centrifugal force on a specimen said rotor with a box type specimen holder centrifuge comprising:

a driving shaft connecting unit for receiving rotational force from a driving shaft of said centrifuge;

a bottom plate connected to said driving shaft connecting unit;

an outer wall with inner side thereof in parallel to an axis of rotation, said outer wall being extending upward from said bottom plate;

a box type specimen holder with a plurality of recesses for accommodating the specimens, said box type specimen holder having a lateral side and a collar extending outside beyond said lateral side, said box type specimen holder having a thickness such that a position of gravitational force directed downward from the center of gravity of said box type specimen holder is located at a point outside of a range defined between two contact points serving as points of support where said box type specimen holder comes into contact with a flat surface in said rotor when said box type specimen holder is erected vertically;

specimen receptacles each extending in direction parallel to said axis of the rotation along said outer wall, each of said specimen receptacles being placed in radial direction with respect to the axis of rotation, said box type specimen holder being acceptable in each of said specimen receptacles; and means for preventing said box type specimen holder from toppling down.

2. A rotor with a box type specimen holder for centrifuge according to claim 1, wherein a sealing member is provided to cover said plurality of recesses on said box type specimen holder.

3. A rotor with a box type specimen holder for centrifuge according to claim 1, wherein there is provided a guide plate fixed on said rotor for centrifuge and having said specimen receptacles.

4. A rotor with a box type specimen holder for centrifuge according to claim 3, wherein said guide plate itself is used as said means for preventing the specimen holder from toppling down.

5. A rotor with a box type specimen holder for centrifuge according to claim 3, wherein a support member for holding said box type specimen holder is provided and is used as the means for preventing said specimen holder from toppling down, said support member having a first portion which comes into contact with inner periphery of said outer wall and a second portion for supporting said box type specimen holder.

6. A rotor with a box type specimen holder for centrifuge according to claim 1, wherein a pad for receiving centrifugal force to be applied on said box type specimen holder and having such shape as to engage with the shape of said outer wall is arranged between said box type specimen holder and said outer wall.

7. A rotor with a box type specimen holder for centrifuge according to claim 1, wherein a cover unit for covering upper opening of said rotor for centrifuge is provided.

8. A rotor for centrifuge to apply centrifugal force on a specimen by holding and rotating a box type specimen holder with a plurality of recesses for accommodating the specimens, said rotor for centrifuge comprising:

an outer wall with inner side thereof in parallel to an axis of rotation of said rotor;

specimen receptacles each extended in direction of said axis of rotation along said outer wall, whereby each of said specimen receptacles is placed in radial direction with respect to said axis of rotation, said box type specimen holder is arranged in each of said specimen receptacles;

a guide plate fixed on said rotor for centrifuge and having said specimen receptacles; and a fixed plate for supporting axial lateral side of the box type specimen holder provided on said guide plate to be used as a means for preventing the box type specimen holder from toppling down.

9. A rotor for centrifuge according to claim 8, further comprising means for adjusting the position of the fixed plate to cope with different types of said box type specimen holder each having different thickness.

10. A rotor for centrifuge to apply centrifugal force on a specimen by holding and rotating a box type specimen holder with a plurality of recesses for accommodating the specimens, said rotor for centrifuge comprising:

an outer wall with inner side thereof in parallel to an axis of rotation of said rotor;

specimen receptacles each extended in direction of said axis of rotation along said outer wall, whereby each of said specimen receptacles is placed in radial direction with respect to said axis of rotation, said box type specimen holder is arranged in each of said specimen receptacles;

a guide plate fixed on said rotor for centrifuge and having said specimen receptacles; and a stopper for supporting a collar on the lateral side of said box type specimen holder provided on said guide plate to be used as the means for preventing the specimen holder from toppling down.

11. A rotor for centrifuge to apply centrifugal force on a specimen by holding and rotating a box type specimen holder with a plurality of recesses for accommodating the specimens, said box type specimen holder having a lateral side and a collar extending outside beyond said lateral side, said box type specimen holder having a thickness such that a position of gravitational force directed downward from the center of gravity of the box type specimen holder is located at a point outside of a range defined between two contact points serving as points of support where the box type specimen holder comes into contact with a flat surface in said rotor when said box type specimen holder is erected vertically, said rotor for centrifuge comprising:

a driving shaft connecting unit for receiving rotational force from a driving shaft of said centrifuge;

a bottom plate connected to said driving shaft connecting unit;

an outer wall with inner side thereof in parallel to an axis of rotation, said outer wall being extending upward from said bottom plate;

specimen receptacles each extending in direction parallel to said axis of the rotation along said outer wall, each of said specimen receptacles being placed in radial direction with respect to the axis of rotation, said box type specimen holder being acceptable in each of said specimen receptacles;

a guide plate fixed on said rotor for centrifuge and having said specimen receptacles; and means for preventing said box type specimen holder from toppling down, said means including a support member for holding said box type specimen holder provided and used as said means for preventing said specimen holder from toppling down, said support member having a first portion which comes into contact with inner periphery of said outer wall and a second portion for supporting said box type specimen holder, said first and second portions of said support member being located with a space therebetween so that at least a portion of said box type specimen holder is received in said space thereby preventing said specimen holder from toppling down.

12. A rotor for centrifuge to apply centrifugal force on a specimen by holding and rotating a box type specimen holder with a plurality of recesses for accommodating the specimens, said box type specimen holder having a lateral side and a collar extending outside beyond said lateral side, said box type specimen holder having a thickness such that a position of gravitational force directed downward from the center of gravity of the box type specimen holder is located at a point outside of a range defined between two contact points serving as points of support where the box type specimen holder comes into contact with a flat surface in said rotor when said box type specimen holder is erected vertically, said rotor for centrifuge comprising:

a driving shaft connecting unit for receiving rotational force from a driving shaft of said centrifuge;

a bottom plate connected to said driving shaft connecting unit;

an outer wall with inner side thereof in parallel to an axis of rotation, said outer wall being extending upward from said bottom plate;

specimen receptacles each extending in direction parallel to said axis of the rotation along said outer wall, each of said specimen receptacles being placed in radial direction with respect to the axis of rotation, said box type specimen holder being acceptable in each of said specimen receptacles;

a guide plate fixed on said rotor for centrifuge and having said specimen receptacles; and means for preventing said box type specimen holder from toppling down, said means including a support member for holding said box type specimen holder provided and used as said means for preventing said specimen holder from toppling down, said support member having a first portion which comes into contact with inner periphery of said outer wall and a second portion for supporting said box type specimen holder, said support member having a bottom supporting segment for receiving the lower portion of said box type specimen holder, and said bottom supporting segment being used as the means for preventing the specimen holder from toppling down.

13. A rotor for centrifuge to apply centrifugal force on a specimen by holding and rotating a box type specimen holder with a plurality of recesses for accommodating the specimens, said rotor for centrifuge comprising:

a driving shaft connecting unit for receiving rotational force from a driving shaft of said centrifuge;

a bottom plate connected to said driving shaft connecting unit;

an outer wall with inner side thereof in parallel to an axis of rotation, said outer wall being extending upward from said bottom plate;

specimen receptacles each extending in direction of said axis of rotation along said outer wall;

a pad arranged between said box type specimen holder and said inner wall in parallel to said axis of rotation for receiving centrifugal force to be applied on said box type specimen holder, said pad having such shape as to engage with the shape of said outer wall; and a projected segment for supporting rear surface of the specimen accommodating recesses on said box type specimen holder, said projected segment being provided on a seat surface of said pad for supporting said box type specimen holder.

14. A rotor for centrifuge according to claim 13, further comprising a stopper fixed on said pad, said stopper having a portion which can be engaged with a collar of said box type specimen holder at an upper portion thereof when it is erected vertically.

* * * * *

UNITED STATES PATENT AND TRADEMARK OFFICE

CERTIFICATE OF CORRECTION

PATENT NO. : 6,416,455 B1
DATED : July 9, 2002
INVENTOR(S) : Masaharu Aizawa et al.

It is certified that error appears in the above-identified patent and that said Letters Patent is hereby corrected as shown below:

Title page, Item [54] and Column 1, line 2,
Replace "ACCOMODATES" with -- ACCOMMODATES --

The Title should appear as:
-- ROTOR FOR CENTRIFUGE HAVING A SPECIMEN HOLDER THAT ACCOMMODATES AN INCREASED NUMBER OF SPECIMENS --

Title page,
Item [73], Assignee, change "Hirachi Koki Co., Ltd., Tokyo (JP) with -- Hitachi Koki Co., Ltd,, Tokyo (JP) --

Signed and Sealed this

Twenty-first Day of January, 2003

JAMES E. ROGAN
*Director of the United States Patent and Trademark Office*